US005167414A

United States Patent [19]

Montgomery, III

[11] Patent Number: 5,167,414

[45] Date of Patent: Dec. 1, 1992

[54] GOLF PUTTER

[76] Inventor: Thaddeus J. Montgomery, III, 81 Culver La., Portland, Conn. 06480

[21] Appl. No.: 741,055

[22] Filed: Aug. 6, 1991

[51] Int. Cl.[5] ..... A63B 53/04

[52] U.S. Cl. ..... 273/169; 273/167 B; 273/167 F; 273/164.1

[58] Field of Search ..... 273/77 R:77 A, 167 R, 273/167 A, 167 B, 167 D, 167 F, 169, 171, 172, 163 R, 164, 183 D; D21/217, 218, 219

[56] References Cited

U.S. PATENT DOCUMENTS

| | | | |
|---|---|---|---|
| D. 279,497 | 7/1985 | Brown | D21/219 |
| D. 306,629 | 3/1990 | Shearer | D21/219 |
| 2,478,468 | 8/1949 | Drake | 273/167 A |
| 3,143,349 | 8/1964 | MacIntyre | 273/167 R |
| 3,318,602 | 5/1967 | Kunihisa | 273/164 |
| 3,486,755 | 12/1969 | Hodge | 273/164 |
| 3,873,094 | 3/1975 | Sebo et al. | 273/163 R |
| 3,921,984 | 11/1975 | Winter | 273/164 F |
| 3,966,210 | 2/1976 | Rozmus | 273/169 |
| 4,325,553 | 4/1982 | Taylor | 273/167 F |
| 4,390,184 | 6/1983 | Rudell | 273/183 D |
| 4,898,387 | 2/1990 | Finney | 273/167 F |
| 4,984,799 | 1/1991 | Finney | 273/169 |
| 4,995,612 | 2/1991 | Finney | 273/169 |
| 5,060,950 | 10/1991 | Finney | 273/167 F |

FOREIGN PATENT DOCUMENTS

| | | | |
|---|---|---|---|
| 328823 | 5/1930 | United Kingdom | 273/163 R |

OTHER PUBLICATIONS

*Golf World*, Jul. 2, 1976, p. 31.

*Primary Examiner*—William H. Grieb
*Assistant Examiner*—William M. Pierce
*Attorney, Agent, or Firm*—Robert H. Montgomery

[57] ABSTRACT

A golf putter head which is cast in one piece and comprises a face plate including a striking surface adapted to strike a golf ball with a sole plate extending rearwardly from the face plate at the lower end having an arcuate lower surface which is designed to accommodate golfers of different heights, an upper weighting member, spaced above the sole plate also extends rearwardly of the faceplate and is constructed so as to provide two rearwardly projecting wing members which define a V-shaped recess having a bight which is essentially perpendicular to the striking face of the face plate, and a line or score mark is defined on the weighting member which is essentially perpendicular to the striking surface of the face plate to aid the golfer in aligning the putt. The weight distribution between the sole plate and the upper weighting member is such as to impart overspin to a golf ball and thereby insure that the ball rolls when struck and does not slide nor skid over a green.

20 Claims, 2 Drawing Sheets

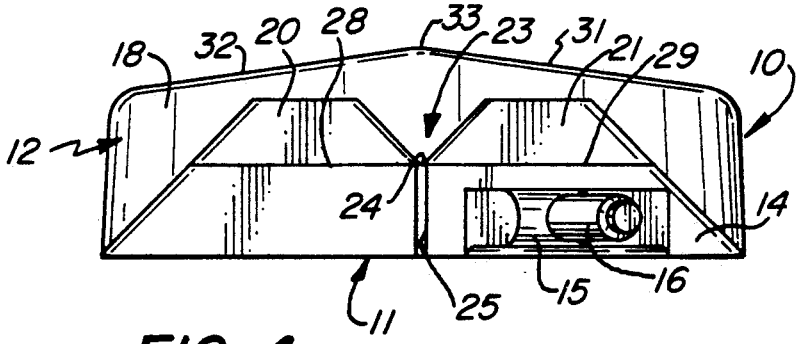
FIG. 4
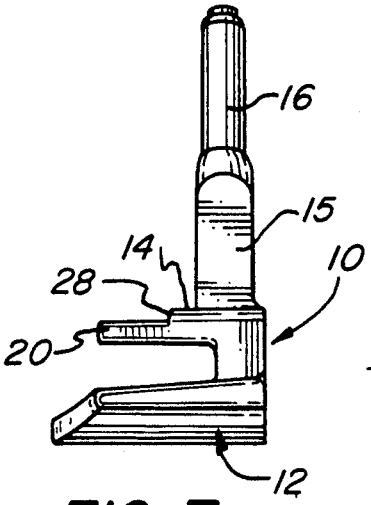
FIG. 7
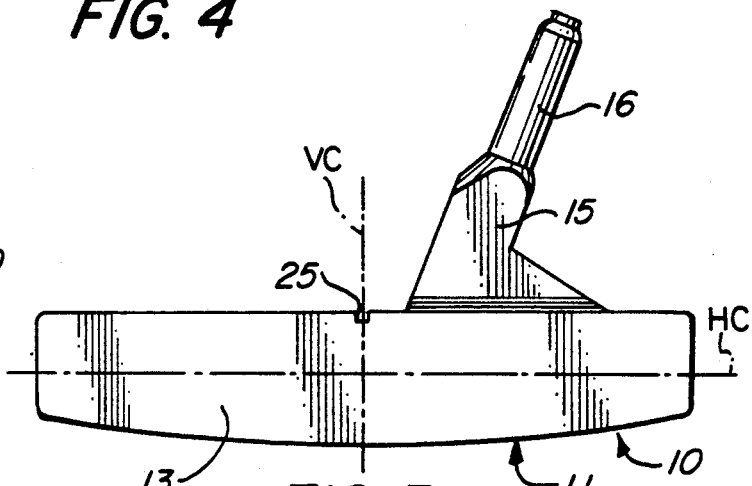
FIG. 3
FIG. 5
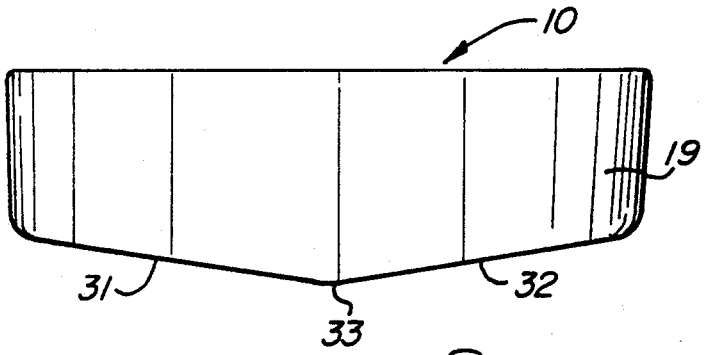
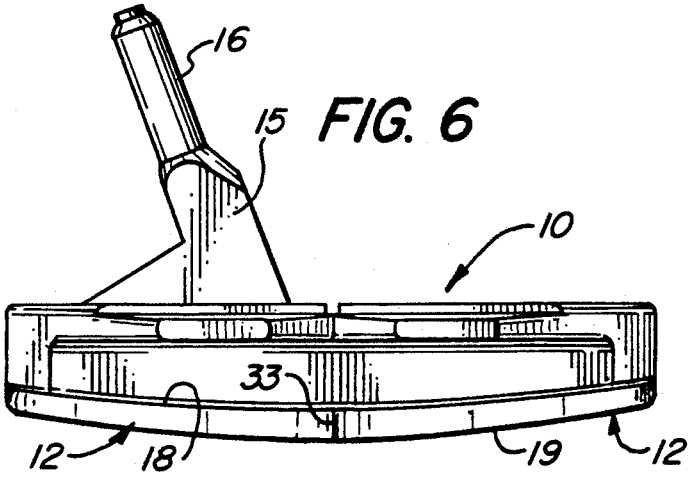
FIG. 6
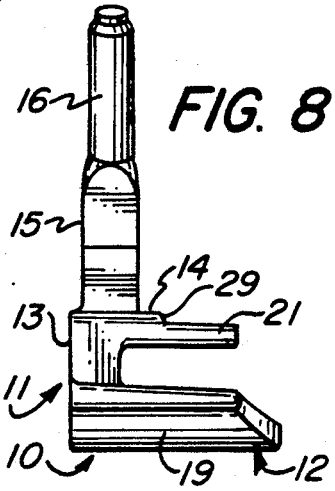
FIG. 8

GOLF PUTTER

FIELD OF THE INVENTION

This invention relates to golf clubs and more particularly relates to a golfing club commonly termed a putter.

BACKGROUND OF THE INVENTION

In golf, one of the most important points of obtaining a reduced number of strokes is the accuracy of putting once the green has been reached by the golfer. In the rating of a golf hole as to par two strokes are allotted for putting while the other strokes are based on the distance from the tee to the green. Accordingly, a golfing hole may have a par rating generally of three, four or five in which two of the strokes are for putting once the green has been reached.

Golfing professionals are generally very good putters and over the years of training and experience have been able to hold the golf club squarely and stroke the ball in a smooth straight motion. On the other hand many amateur golfers have difficulty in developing a consistently straight and smooth groove stroking motion and consequently the putting is often the downfall of their overall game.

Problems facing the amateur golfer include correctly positioning his/or head over the putter and the golf ball, properly aligning the putter face with the golf ball and stroking the ball squarely so as to impart a forward roll to the ball without an initial skidding action.

As a result there have many and varied attempts to provide designs of putter heads that are acceptable and which will provide confidence in the golfer using such putters.

Putters may take many and varied shapes such as merely being a flat blade, or what is referred to as a mallet head which comprises a body member with a weighted back portion and a flat face. In addition, there have been many types of what may be referred to as novelty designs as exemplified by U.S. Pat. No. 3,921,984 designed to facilitate alignment of the putter with the intended direction of travel of the golf ball. Also U.S. Pat. No. 4,390,184 showing a generally W-shaped putter. Also attempts have been made for the putters to have specifically distributed weights to enhance the design for a putter. See for example U.S. Pat. Nos. 4,984,799 and 4,898,387 which relate to fabricated putter heads with built in weights.

It is desired that a putter impart immediate over spin to a golf ball in order that the ball after being struck rolls and does not skid or slide on the surface of a putting green.

Accordingly, the present invention provides a new and improved unicast golfing putter which enables a golfer to properly position the putter head regardless of height of the golfer, which is so weighted as to impart over spin to a struck ball and improves the sight alignment of the putter striking face with the golf ball.

An object of this invention is to provide a new and improved golf putter.

Another object of this invention is to provide a golf putter of a new and improved weighted design which will always impart overspin to the struck ball.

A further object of this invention is to provide a golf putter in which golfers of various heights and arm lengths may easily adapt.

SUMMARY OF THE INVENTION

Briefly stated, the present invention in one form thereof comprises a golf putter head which is cast in one piece and comprises a face plate including a striking surface adapted to strike a golf ball. Extending rearwardly from the face plate at the lower end thereof is a sole plate having an arcuate lower surface which is designed to accommodate golfers of different heights. An upper weighting member, spaced above the sole plate also extends rearwardly of the faceplate and is constructed so as to provide two rearwardly projecting wing members which define a V-shaped recess having a bight which is essentially perpendicular to the striking face of the face plate. A line or score mark is defined on the weighting member which is essentially perpendicular to the striking surface of the face plate to aid the golfer in aligning the putt. The weight distribution between the sole plate and the upper weighting member is such as to impart overspin to a golf ball and thereby insure that the ball rolls when struck and does not slide nor skid over the green.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

BRIEF DESCRIPTION OF THE DRAWINGS

FIG. 3 is a front elevation of a golf putting head embodying the invention;

FIG. 4 is a top plan view of a golfing putter embodying the invention;

FIG. 5 is a bottom plan view of a golfing putter head embodying the invention;

FIG. 6 is a rear elevation of a golfing putter head embodying the invention;

FIG. 7 is a side elevation of the golfing putter head seen from the left of FIG. 4, and;

FIG. 8 is a side elevation of a golfing putter head seen from the right side of FIG. 4.

DETAILED DESCRIPTION OF PREFERRED EMBODIMENT OF THE INVENTION

Figure 1:
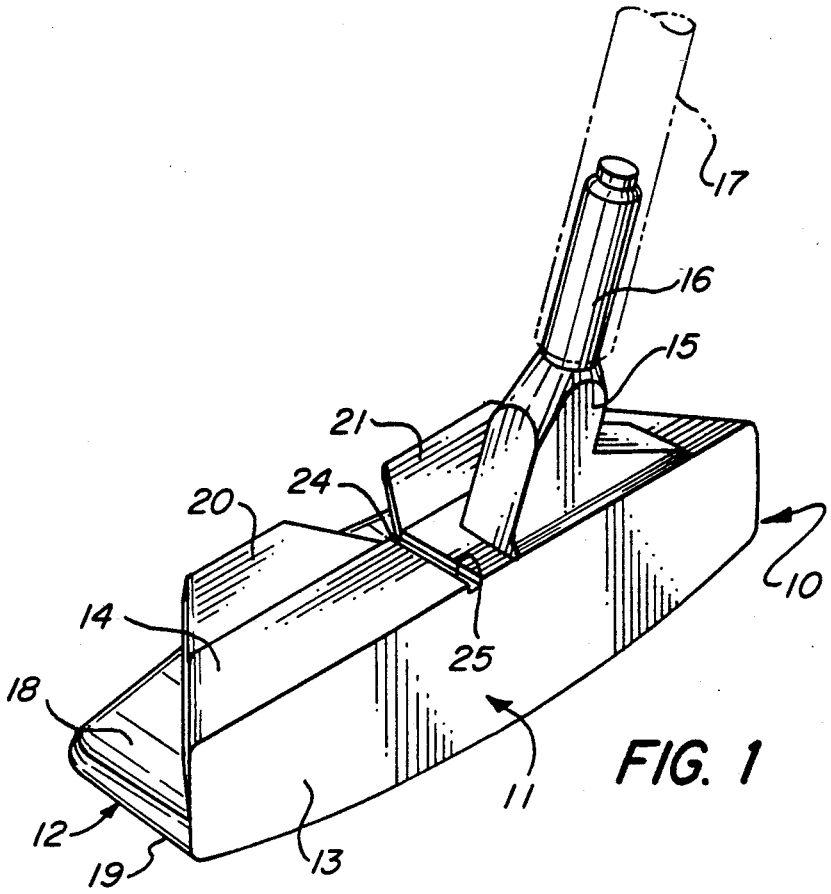
FIG. 1 is a perspective view seen primarily from a front quarter of a golf putter head embodying the invention.
Figure 2:
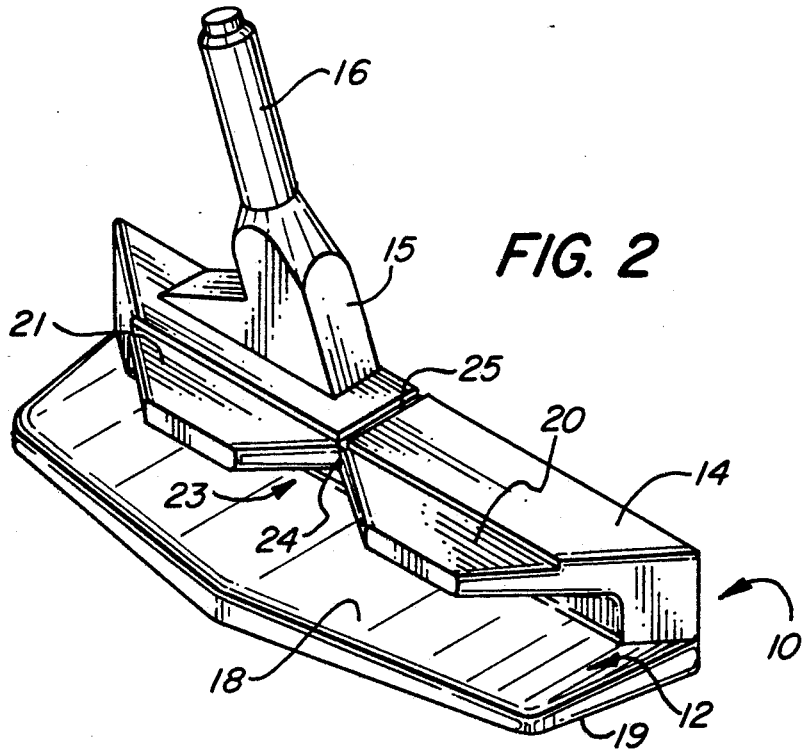
FIG. 2 is a perspective view seen from a rear quarter of a golf putting head embodying the invention.

Reference is now made to FIG. 1 which shows a one piece cast golf putting head 10 embodying the invention. This golf putter head is uni-cast and comprises a first portion face plate 11, a sole plate 12, extending rearwardly of face plate 11. Face plate has an essentially planar striking face 13 spaced upwardly from sole plate 12. Extending rearwardly of face plate 11 in the same direction as sole plate 12 is an upper portion defining a weighting member 14. Cast on and extending from weighting member or portion 14 is a hosel 15 having an upwardly extending shaft portion 16 which is adapted to receive thereover a shaft 17 shown in broken line. The shaft is preferably attached to the hosel shaft 16 by means of a polymer or other plastic bonding agent. Sole plate 12 has an upper surface 18 as will hereinafter be described and a lower surface 19 as shown in FIG. 5.

Extending from and forming a portion of weighting member 14 are wing members 20 and 21 for weighting purposes. The wing members 20 and 21 define therebetween a V-shaped recess as indicated by the reference numeral 23 with the bight or vertex 24 of the V extending to a groove 25 in weighting member 14 which extends perpendicular to the striking surface 13 of face plate 11. Alternatively, the groove 25 could be replaced by a marker on the top surface of weighting member 14 for the same purposes. The bight or vertex of the V-shape 23 and the marker 25 extend essentially perpendicular to striking face 11 and surface 13 in order to give the user of the putter a line for hitting or striking a golf ball on what is referred to as the sweet spot of the putter. The recess 23 is defined between adjacent surfaces of wing members 20 and 21.

The lower surface of the sole plate 26 as shown in FIG. 5 is arcuately defined on a large radius. This permits the golfer to adjust to the height of his hands on the grip on the putters shaft 17.

As most clearly exemplified in FIG. 4 the sole plate 12 extends beyond the weighting member 14 and the wings 20 and 21 thereon so that the golfer will have a view of the sole plate in relation to the recessed V-portion 23 and the marker 25 which is perpendicular to face plate 13.

It is preferred and a feature of the invention that the sole plate 12 extend outwardly beyond the wings 20 and 21 in order that the golfer has a better view of the putter head as a whole and he may see the sole plate extending beyond the wings 20 and 21. This gives a background to the weighting member V-recess 23 and marker or groove 25, which enables a better sighting of the putter with respect to the ball.

As shown in FIG. 7 the top or upper surface 18 of the sole plate may be made arcuate for weighting purposes. This will depend on the preference of the golfer. Alternatively, the top or upper surface of the sole plate 18 could be made horizontal. As may be seen from FIGS. 7 and 8, the sole plate 12 and weighting member 14 are vertically spaced apart throughout their lengths.

The wings 20 and 21 could have straight extensions on the outer edges from weighting member 14 or may be angled on the outer edges as shown in FIG. 4. This is a matter of weight distribution as hereinafter discussed.

The wings 20 and 21 may have shoulders 28 and 29 respectively defined thereon, as shown in FIGS. 4, 7 and 8 to remove material therefrom for weighting purposes.

The shoulders 28 and 29 maybe defined for weighting requirements of the experienced amateur or the professional as to the weight distribution that they may desire. Even after the basic head is cast as shown, or is cast with the surface 18 horizontal, an experienced golfer may desire additional machine work to remove a portion of the golfing head for the weight distribution that he or she may require. Additionally, the striking surface 13 is preferably machined to be planar to at least 0.0002".

Reference is now made to FIG. 3, which shows a horizontal center line HC and a vertical center line VC through the putter head. The so called "sweet spot" of the putter is approximately one half (½) inch on either side of vertical center line VC. The putter head is symmetrical on either side of vertical center line VC including the weight distribution, but with the exception of hosel 15. The vertical center line VC extends through the center of groove or marker 25.

The putter head 10 is so constructed and arranged that in a preferred embodiment the weight distribution on either side of horizontal center line HC is approximately equal.

In the preferred embodiments of the invention the weight distribution of the putter head as between the upper and lower portions on either side of the horizontal center line HC is approximately equal. This may be modified by removing material from the wings 20 and 21 at the shoulders 28 and 29 to distribute the weight above and below horizontal center line HC in accordance with the preference of the golfer.

In a production golf head the percentage of the weight above horizontal center line H/C had been designed to be fifty-two percent (52%) including hosel. However, this may be varied within the scope of the invention in production and further modified by the weight of the wings 20 and 21 as previously discussed.

The hosel is preferably cast integral with the putter head, but may be a separate piece, bonded or other wise connected to the putter head.

The sole plate may be formed as rectangular in plan view. However, it is preferred that it have a weak tapering slope of the rear edges 31 and 32 to a point 33 as shown in FIG. 4. The point 33 may be pointed, or defined on a small radius. This point is in line with groove or marker 25.

A typical example of a putter head embodying the invention on either side of horizontal center line H/C is fifty-two (52%) percent above and forty eight percent below. In this example the hosel makes up about twelve percent (12%) of the weight of the exemplified putter head which is twelve (12) ounces.

A putter head embodying the invention is preferably cast in one piece including the hosel of a strong lightweight alloy such as a zinc-aluminum alloy to impart strength in use of zinc and light weight from the aluminum.

The weight distribution of the putter is such that when a golf ball is struck by the sweet spot of the club, over spin is immediately imparted to the ball causing it to roll forward without spinning or skidding.

While the preferred weight distribution of the putter head on either side of horizontal center line is approximately equal, the weight distribution may be 40–60 in either direction and the same results achieved.

It may thus be seen that the objects of the invention set forth, as well as those made apparent from the foregoing description, are efficiently attained. While a preferred embodiment of the invention has been set forth for purposes of disclosure, modification to the disclosed embodiment of the invention, as well as other embodiments thereof, may occur to those skilled in the art. Accordingly, the appended claims are intended to cover all embodiments of the invention and modifications to the disclosed embodiment which do not depart from the spirit and scope of the invention.

What is claimed is:

1. A golf putter head formed in one piece and comprising a body member defining a striking face in a substantially vertical plane when said putter head is in an operative position, said body member having opposed spaced apart top and bottom portion comprising a sole plate extending at an angle from said striking face, said sole plate having a lower surface defining a lower boundary of said putter head, said top portion comprising a weighing portion extending from said striking face in the same direction as said sole plate and spaced above said sole plate, said weighing portion having a pair of wing members having edges defining a v-shaped recess therebetween, said V-shaped recess having a vertex substantially centrally of said weighing portion said vertex of said V-shaped recess being defined by a common point on said edges of said wing members, a marker defined on the upper surface of said weighing portion extending to said striking face from said vertex and essentially perpendicular to said striking face, and means defined on said weighing portion for receiving a shaft therein.

2. The golf putter head of claim 1 wherein said sole plate extends beyond said weighting portion.

3. The golf putter head of claim 2 where the end of said sole plate extending beyond said weighting portion forms a shallow V-shape.

4. The golf putter head of claim 1 wherein the means defined on said weighting portion is a hosel for receiving a shaft extending from said weighting portion.

5. The golf putter head of claim 1 wherein said sole plate has an upper arcuate surface.

6. The golf putter of claim 1 wherein the weight distribution of said head as measured from the horizontal center line of said striking face is such that the weight above said center line is slightly greater than the weight below said center line.

7. The golf putter head of claim 1 wherein the weight distribution of said golf putter head is substantially equal as measured from either side of the horizontal center line of said striking face.

8. The golf putter head of claim 1 wherein said marker is a groove defined in said weighting portion.

9. A golf putter head formed in one piece and comprising a first portion defining an essentially planar striking face adapted to strike a golf ball, a lower sole plate extending at an angle from said first portion away from said striking face, said sole plate having arcuate upper and lower surfaces, said lower arcuate surface defining the lower boundary of said putter head, a weighting portion extending from said striking face in the same direction as said sole plate and spaced upwardly from said sole plate, said weighting portion defining a pair of wing members extending in the same direction as said sole plate, said wing members having edges therebetween defining a V-shaped recess having a vertex centrally of said putter head, said vertex of said V-shaped recess being defined by a common point on said side edges of said wing members, a groove defined on the upper surface of said weighting portion extending essentially perpendicular from said vertex toward said striking surface, and means defined on said weighting portion for receiving a shaft therein.

10. The golf putter head of claim 9 wherein said sole plate extends beyond said weighting portion.

11. The golf putter head of claim 10 where the rear end of said sole plate forms a shallow V-shape.

12. The golf putter head of claim 9 further including a hosel for accepting a shaft extending from said weighting portion.

13. The golf putter head of claim 9 therein said sole plate has an upper arcuate surface.

14. The golf putter head of claim 9 wherein the weight distribution of said golf putter head is substantially equal as measured from either side of the horizontal center line of said striking face.

15. The golf putter head of claim 9 wherein said marker is a groove defined in said weighting portion.

16. The golf putter head of claim 9 wherein said sole plate is defined at the rear thereof by two tapered edges which reach an apex in line with said marker.

17. The golf putter head of claim 9 where said wing members have outside surfaces which are angled inwardly from said striking surface on the outside edges thereof.

18. A golf putter comprising a head formed in one piece and comprising a first portion defining a striking face in a substantially vertical plane when said putter head is in an operative position.

a sole plate extending from said first portion away from said striking face, said sole plate having a lower surface defining the lower boundary of said putter head, a weighing portion extending from said first portion in the same direction as said sole plate and spaced throughout its length above said sole plate.

said weighing portion having a pair of wing member having edges defining a V-shaped recess therebetween, said V-shaped recess having a vertex substantially centrally of said weighing portion said vertex of said V-shaped recess being defined by a common point on said edges of said wing members, a marker defined on the upper surface of said weighing portion extending to said striking face from said vertex and essentially perpendicular to said striking face, and a shaft connected to said head, the weight distribution of said head being substantially equal as measured from either side of the horizontal center line of said striking face.

19. The golf putter of claim 18 wherein the weight distribution of said head as measured from the horizontal center line of said striking face is such that the weight above said center line is slightly greater than the weight below said center line.

20. The golf putter of claim 18 wherein the weight distribution of said head as measured from the horizontal center line of said striking face is such that the weight above said center line is slightly greater than the weight below said center line.

* * * * *